US007163493B1

(12) United States Patent
Kuo

(10) Patent No.: US 7,163,493 B1
(45) Date of Patent: Jan. 16, 2007

(54) TREADMILL HAVING CHANGEABLE SUSPENSION

(76) Inventor: Hai Pin Kuo, No. 15, Lane 833, Wen Hsien Road, Tainan 70459 (TW)

( * ) Notice: Subject to any disclaimer, the term of this patent is extended or adjusted under 35 U.S.C. 154(b) by 0 days.

(21) Appl. No.: 11/335,376

(22) Filed: Jan. 19, 2006

(51) Int. Cl.
*A63B 22/00* (2006.01)

(52) U.S. Cl. ..... 482/54; 482/51

(58) Field of Classification Search ..... 482/51, 482/54

See application file for complete search history.

(56) References Cited

U.S. PATENT DOCUMENTS 5,827,155 A 10/1998 Jensen et al. ..... 482/54
5,993,358 A 11/1999 Gureghian et al. ..... 482/54
6,013,011 A 1/2000 Moore et al. ..... 482/54
6,821,230 B1 * 11/2004 Dalebout et al. ..... 482/51

* cited by examiner

*Primary Examiner*—Glenn E. Richman
(74) *Attorney, Agent, or Firm*—Charles E. Baxley

(57) ABSTRACT

A treadmill includes a tread deck supported on a tread base, and one or more cushioning members disposed below and engaged with the tread deck for cushioning the tread deck and for absorbing impact loads imparted on the tread deck by the users, the cushioning member includes different resilience for applying different cushioning force onto the tread deck when the cushioning member is rotated relative to the tread base. A rod is disposed in the tread base for supporting the cushioning members. One or more gears may be attached to the rod and engaged with a rack of the tread base for rotating the rod and the cushioning members relative to the tread base when the rod and the gear are moved relative to the rack.

7 Claims, 7 Drawing Sheets

TREADMILL HAVING CHANGEABLE SUSPENSION

BACKGROUND OF THE INVENTION

1. Field of the Invention

The present invention relates to a treadmill, and more particularly to a treadmill having a changeable or adjustable suspension system for changeably or adjustably supporting a treadmill deck and for providing a variable impact restraint to the users.

2. Description of the Prior Art

Typical treadmills comprise a treadmill deck supported in a base frame or treadmill base, and an endless belt engaged around the treadmill deck for supporting users. A spring structure may further be provided and disposed between the treadmill base and the treadmill deck for providing resiliency or a cushioning effect to the users.

For example, U.S. Pat. No. 5,827,155 to Jensen et al. discloses one of the typical treadmills comprising an adjustable spring structure having a longitudinally extending leaf spring adjustable to different resilience with a slidable adjustment bar. However, the adjustment bar may not be precisely moved or adjusted relative to the treadmill base and also may not be easily adjusted or operated by the users.

U.S. Pat. No. 5,993,358 to Gureghian et al. discloses another typical treadmill comprising an adjustable or controllable suspension system having spring mounts, and a controllable device for providing the user-variable impact restraint. However, the controllable suspension system comprises a rather complicated configuration that may not be easily manufactured and that is adverse for marketing purposes.

U.S. Pat. No. 6,013,011 to Moore et al. discloses a further typical treadmill comprising elongate springs of adjustable stiffness for absorbing impact loads imparted on the deck by the users. However, the elongate springs may not be easily adjusted to different resilience.

The present invention has arisen to mitigate and/or obviate the afore-described disadvantages of the conventional suspension systems for treadmills.

SUMMARY OF THE INVENTION

The primary objective of the present invention is to provide a treadmill including a changeable or adjustable suspension system for changeably or adjustably supporting a treadmill deck and for providing the user-variable impact restraint.

In accordance with one aspect of the invention, there is provided a treadmill comprising a tread base, a tread deck supported on the tread base, and at least one cushioning member disposed below and engaged with the tread deck for cushioning the tread deck and for absorbing impact loads imparted on the tread deck by a user, the cushioning member including different resilience for applying different cushioning force onto the tread deck when the cushioning member is rotated relative to the tread base.

A rod may further be provided and slidably or rotatably received and supported in the tread base for supporting the cushioning member. The tread base includes two side beams each having a channel for receiving ends of the rod.

The rod includes at least one gear rotatably disposed on the rod and coupled to the cushioning member, and at least one rack attached to the tread base and engaged with the gear for rotating the gear and the cushioning member relative to the tread base when the gear is moved relative to the rack.

A collar is rotatably disposed on the rod and coupled to the cushioning member and the gear.

A moving device may further be provided for moving the rod relative to the tread base. For example, the moving means includes an actuator coupled between the rod and the tread base for moving the rod relative to the tread base.

The cushioning member includes one or more curved grooves for forming different resilience to the cushioning member. The curved grooves of the cushioning member each includes a depth changing from a wider end toward a narrower end for forming the different resilience to the cushioning member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
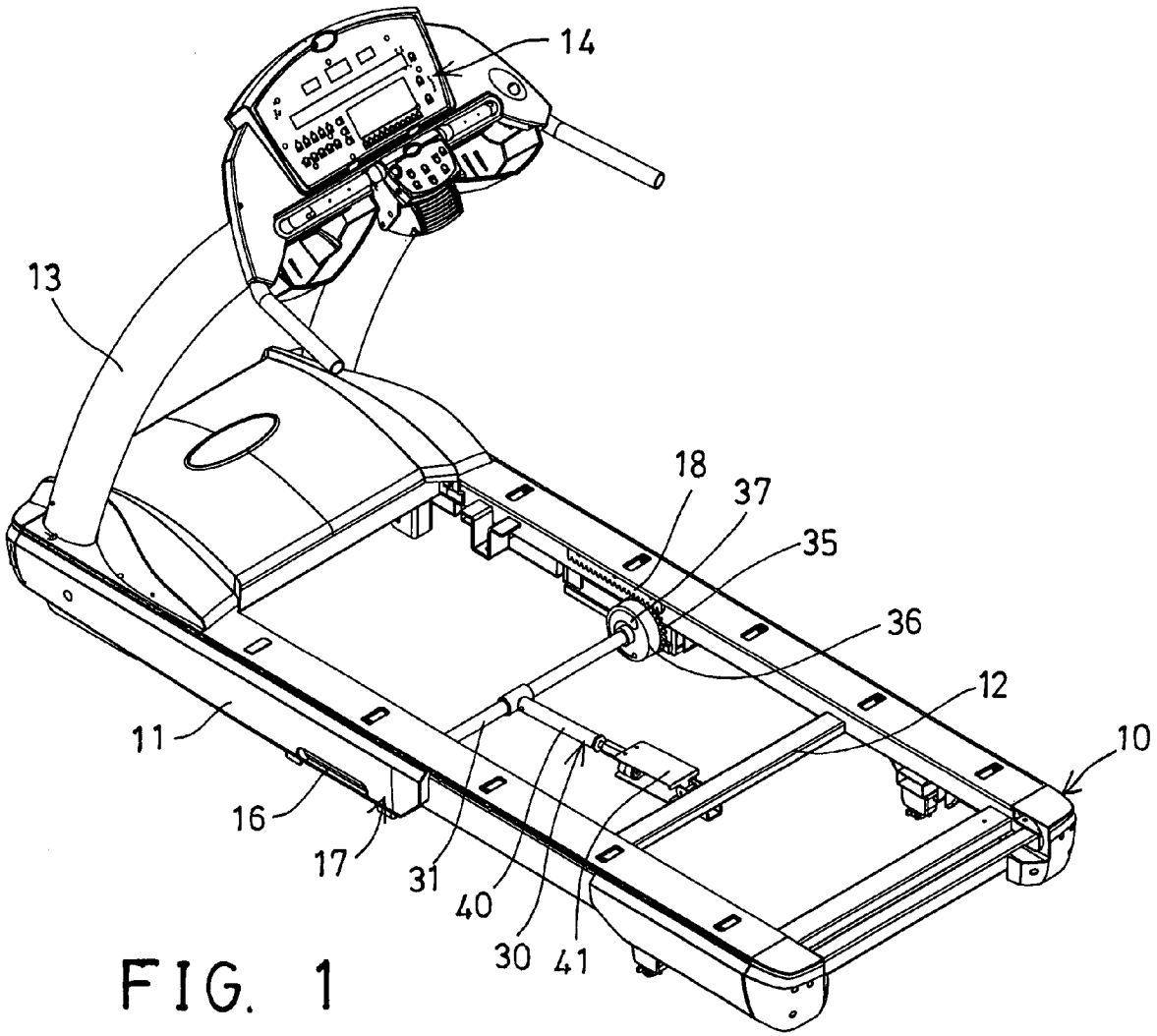
FIG. 1 is a perspective view of a treadmill in accordance with the present invention.
Figure 2:
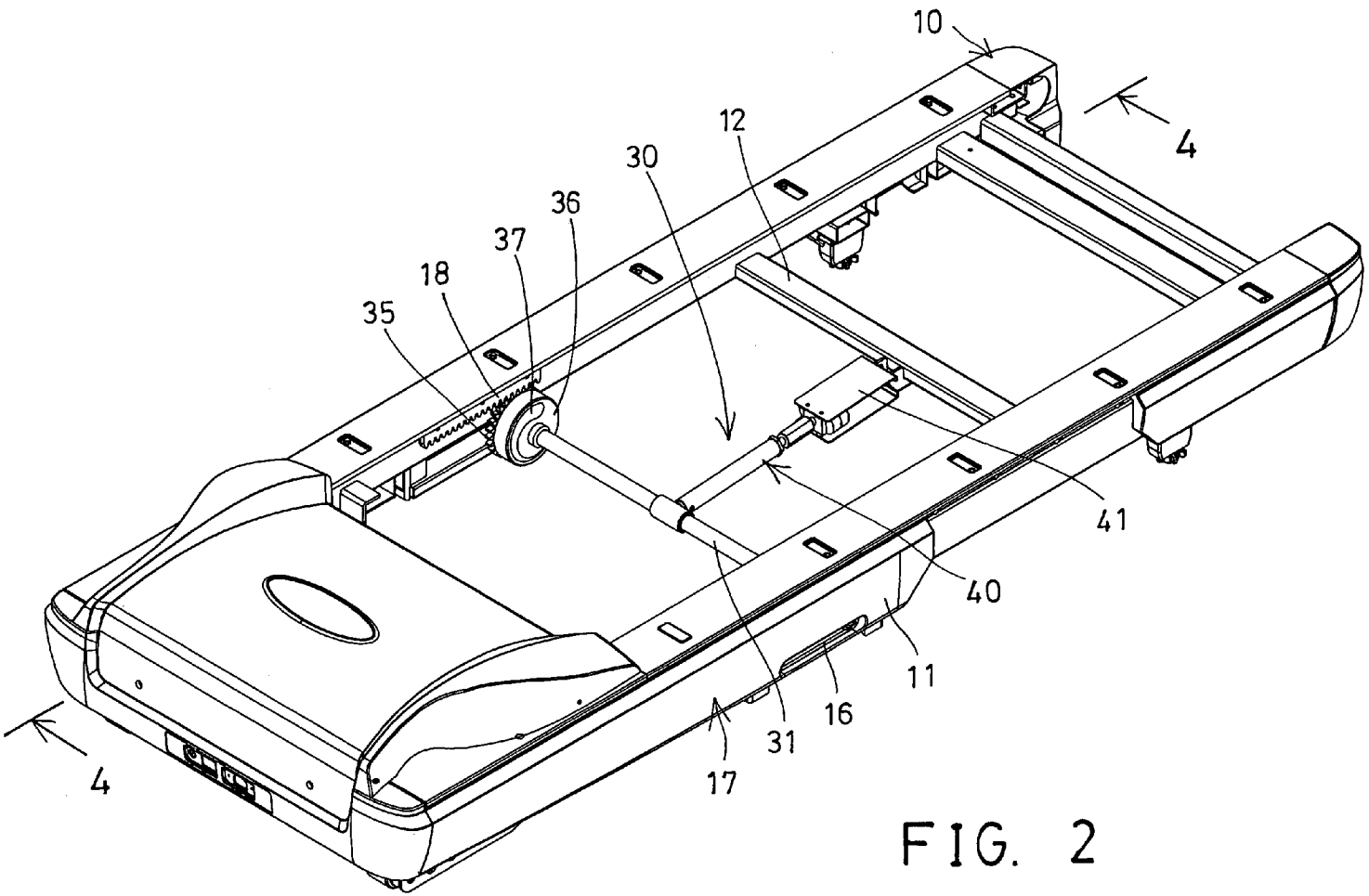
FIG. 2 is a perspective view illustrating a tread base of the treadmill.
Figure 3:
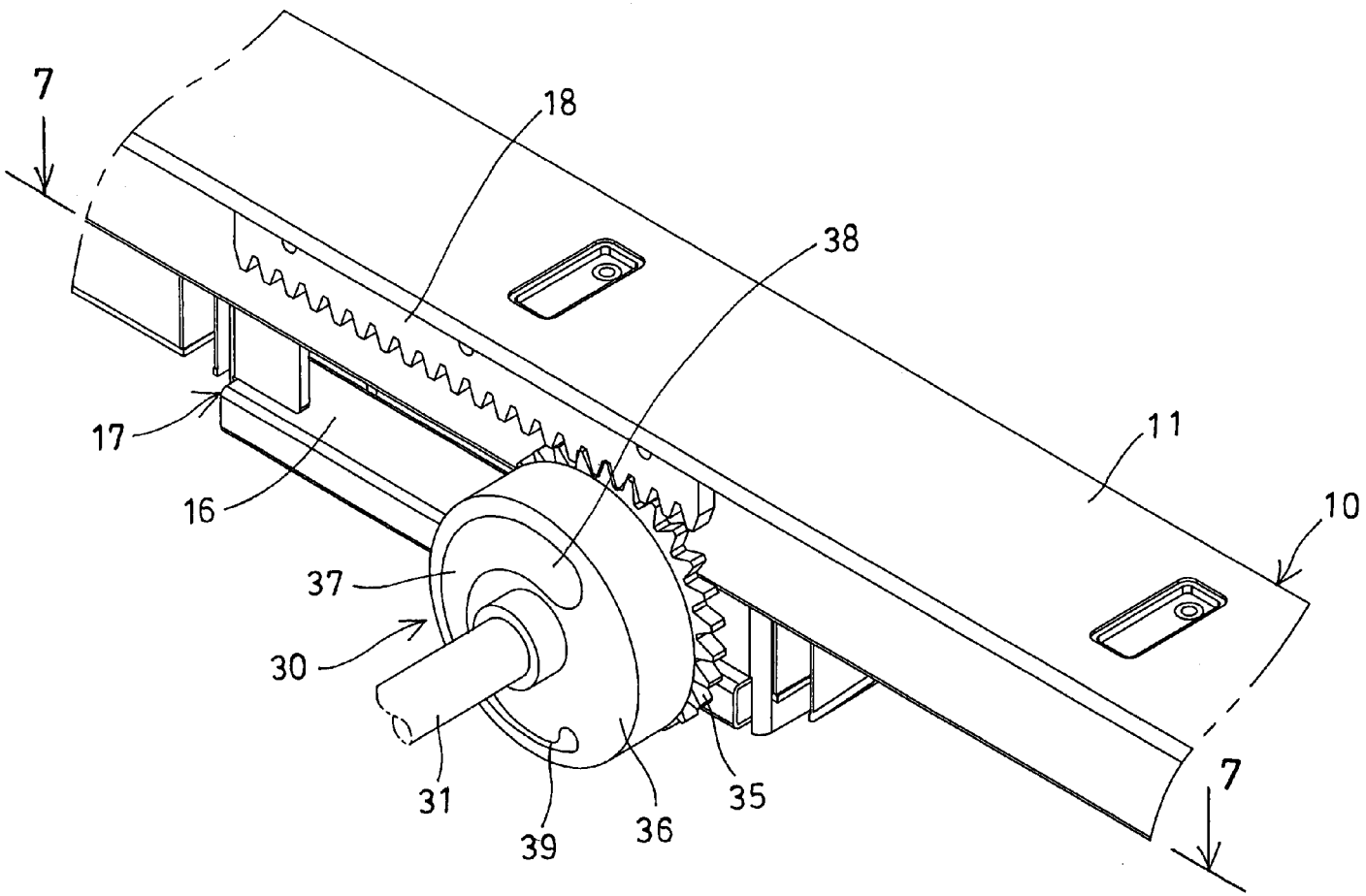
FIG. 3 is an enlarged partial perspective view of the tread base of the treadmill.

Referring to the drawings, and initially to FIGS. 1–7, a treadmill in accordance with the present invention comprises a tread base 10 including two side beams 11, and one or more bars 12 laterally disposed or straddled between the beams 11, for supporting a tread deck 20 on the tread base 10 (FIGS. 4–8). The tread base 10 may include a typical support 13 extended upwardly from the front portion thereof (FIG. 1) for supporting a typical control panel or control device 14 that is typically provided for controlling the treadmill.

The tread base 10 may further include a typical endless belt (not shown) engaged onto or around the tread deck 20 and movable around the tread deck 20 for allowing the user to conduct jogging or running exercises. The tread base 10 may further include a typical power or motor driving device (not shown) for rotating or driving the endless belt. The tread base 10 may further include a typical foldable structure for allowing the treadmill to be folded to a compact folding or storing configuration. The above-identified configuration of the treadmill is typical and will not be described in further details.

The treadmill in accordance with the present invention is to provide a changeable or adjustable suspension system 30 for changeably or adjustably supporting the tread deck 20 and for providing the user-variable impact restraint. For example, one or both of the side beams 11 of the tread base 10 each includes an oblong hole or channel 16 formed in the intermediate or middle portion 17 thereof, and each includes a rack 18 attached or secured to the intermediate or middle portion 17 thereof and preferably aligned or arranged parallel to the channel 16 of the respective side beams 11.

The adjustable suspension system 30 includes a rod 31 having two ends 32 slidably and/or rotatably received in the channels 16 of the side beams 11 (FIGS. 7–8), one or more, such as two bushings or collars 33 rotatably engaged onto such as the ends 32 of the rod 31, for allowing the collars 33 to be rotated relative to the rod 31. One or more, such as two gears 35 are attached or secured onto the collars 33 and also rotated in concert with the collars 33 for meshing or engaging with the racks 18 respectively, and for causing the collars 33 and the gears 35 to be rotated relative to the rod 31 or the tread base 10.

The adjustable suspension system 30 further includes one or more, such as two resilient or cushioning members 36 attached or secured onto the collars 33 and also rotated in concert with the collars 33. The resilient or cushioning members 36 may be made of rubber or synthetic materials and are arranged or disposed below and engaged with the tread deck 20 for resiliently cushioning the tread deck 20 and for absorbing impact loads imparted on the tread deck 20 by the users.

Each of the cushioning members 36 includes one or more, such as two opposite curved grooves 37 formed therein (FIG. 7) and each having a gradually changed thickness or depth changing from a wider or greater end 38 toward a narrower or smaller end 39, best shown in FIGS. 3–7, for forming different or changing resilience or cushioning force in or around each of the cushioning members 36, or for allowing each of the cushioning members 36 to have different resilience to apply onto the tread deck 20 when the cushioning members 36 are rotated relative to the tread base 10.

As shown in FIGS. 1–2 and 4–5, the adjustable suspension system 30 further includes a power driving or actuating or moving means or device 40 coupled to the rod 31 and pivotally coupled to such as one of the bars 12 with a coupler 41. The power driving or moving device 40 may be selected from a pneumatic or hydraulic actuator, a motor-driven bolt-and-nut device, a solenoid actuated device, or the like, for moving the rod 31 along the channels 16 of the side beams 11 and thus for rotating the cushioning members 36 relative to the rod 31 or the tread base 10, in order to change or to adjust the position of the grooves 37 of different or gradually changed thickness or depth and so as to adjust or change the resilience or the cushioning force of the cushioning members 36 applied to the tread deck 20.

Figure 4:
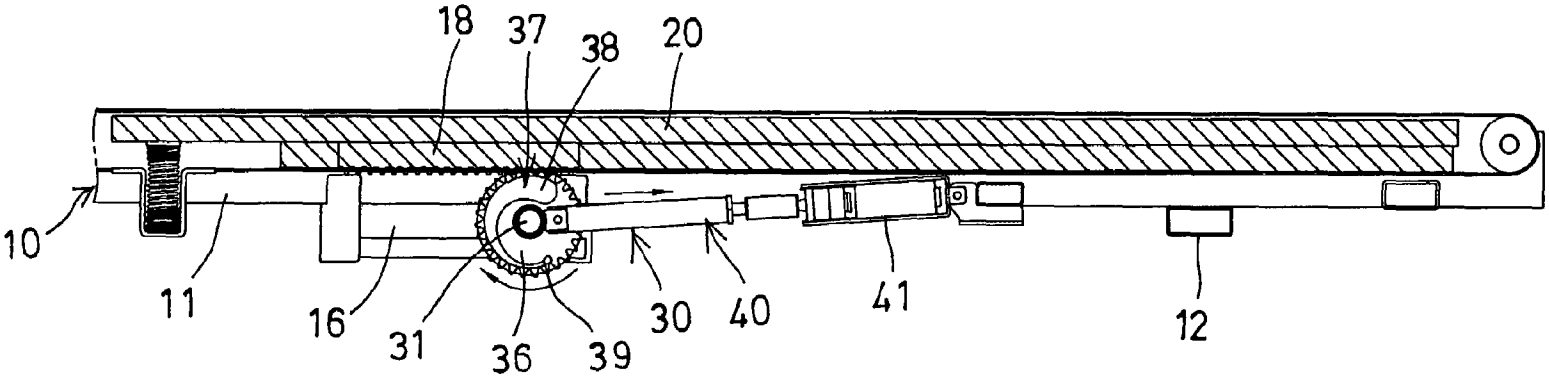
FIG. 4 is a partial cross sectional view of the tread base taken along lines 4—4 of FIG. 2.
Figure 5:
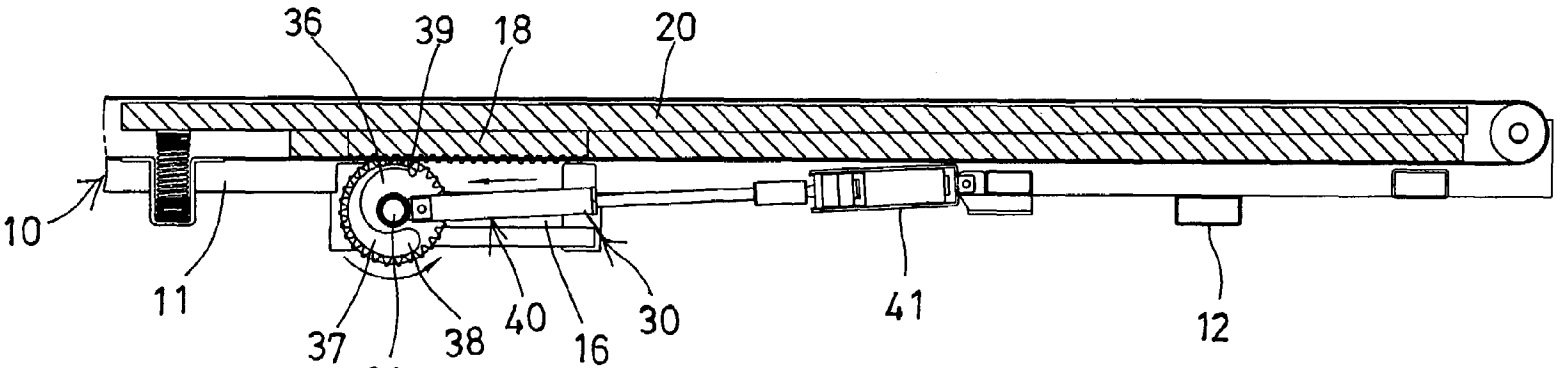
FIG. 5 is a partial cross sectional view similar to FIG. 4, illustrating the operation of the treadmill.
Figure 7:
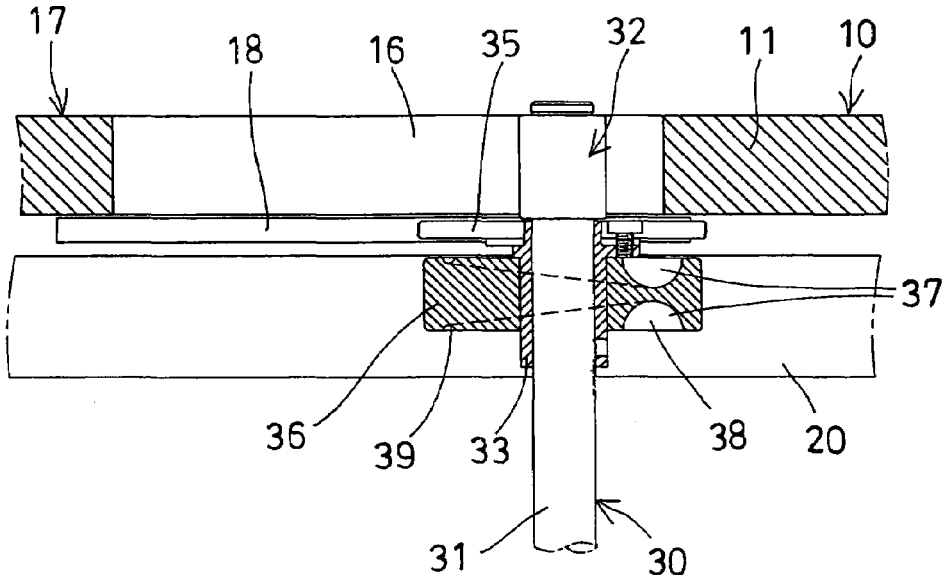
FIG. 7 is a partial cross sectional view of the tread base taken along lines 7—7 of FIG. 3.
Figure 6:
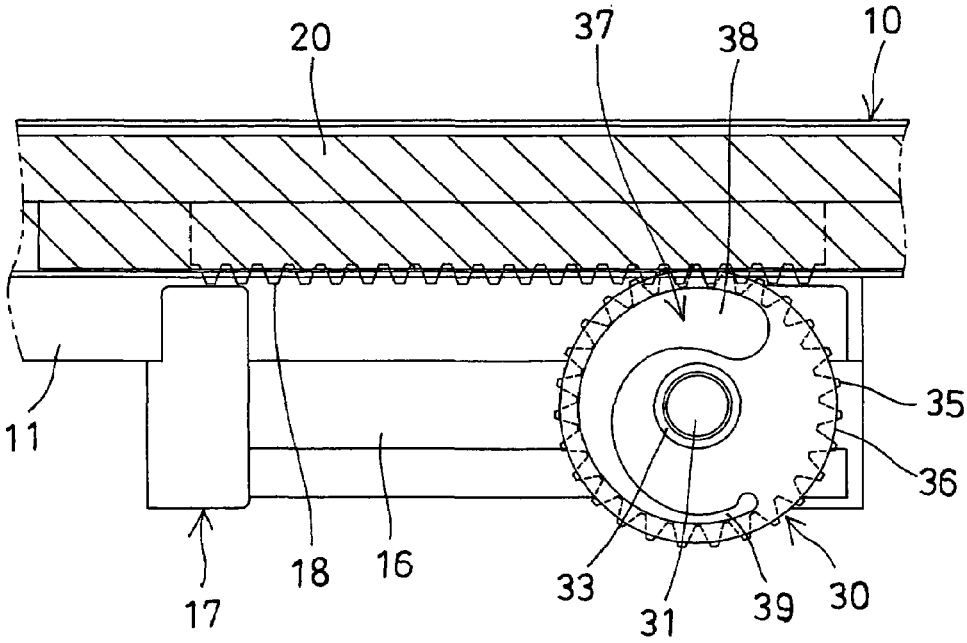
FIG. 6 is a partial plan schematic view of the tread base as shown in FIG. 3.

In operation, as shown in FIGS. 4–7, when the rod 31 is caused to move or slide along the channels 16 of the side beams 11, the engagement between the racks 18 and the gears 35 may cause the gears 35 and thus the cushioning members 36 to be rotated relative to the rod 31 or the tread base 10. As shown in FIGS. 4–5, when the rod 31 is caused to move or slide along the channels 16 of the side beams 11 and when the gears 35 and the cushioning members 36 are caused to be rotated relative to the rod 31 or the tread base 10, the grooves 37 of different or gradually changed thickness or depth may change the resilience or the cushioning force of the cushioning members 36 applied to the tread deck 20.

It is preferable that the power driving or actuating or moving means or device 40 may be controlled via the control panel or control device 14 remotely or by wires, for allowing the user to easily adjust the resilience or the cushioning force of the cushioning members 36 applied to the tread deck 20 without stopping his jogging or running exercises.

Figure 9:
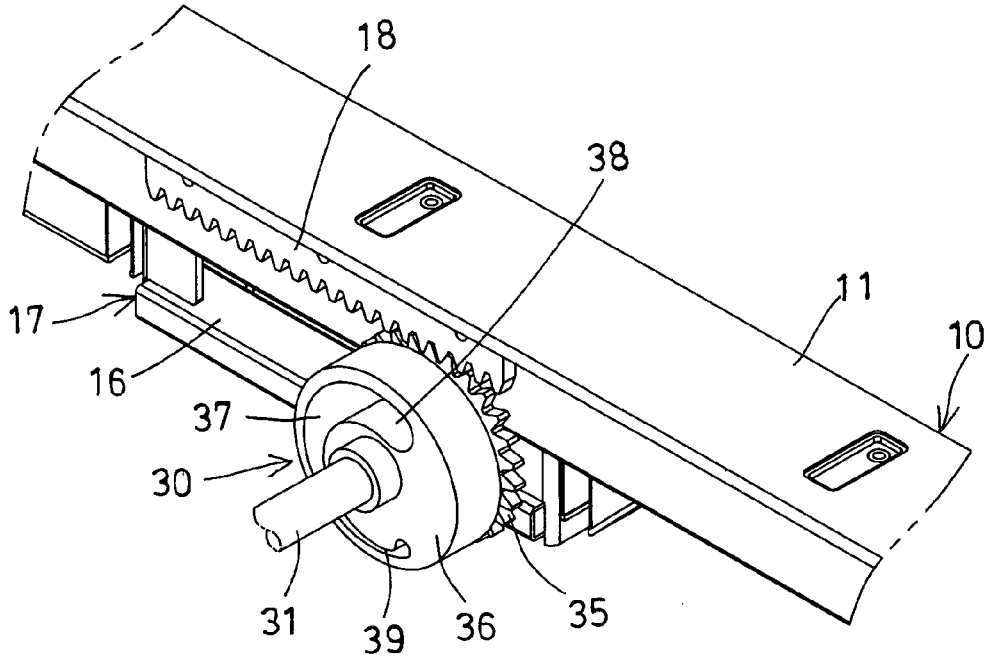
FIG. 9 is an enlarged partial perspective view of the tread base as shown in FIG. 8.
Figure 8:
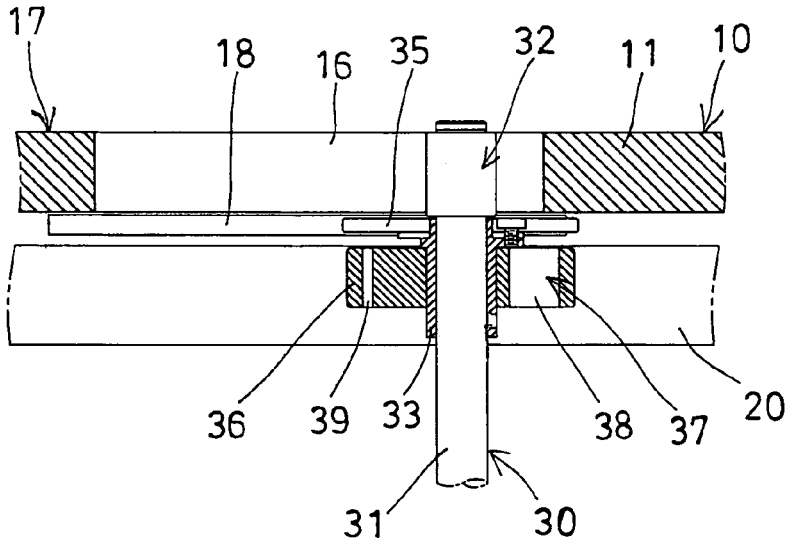
FIG. 8 is a partial cross sectional view similar to FIG. 7, illustrating the other arrangement of the treadmill.

Alternatively, as shown in FIGS. 8 and 9, the curved groove 37 may be a single curved groove 37 formed through two sides of the cushioning members 36, and also includes a gradually changed thickness or depth changing from a wider or greater end 38 toward a narrower or smaller end 39, for allowing the cushioning members 36 to apply changing or adjustable resilience or cushioning force to the tread deck 20 when the cushioning members 36 are rotated relative to the tread base 10.

Figure 10:
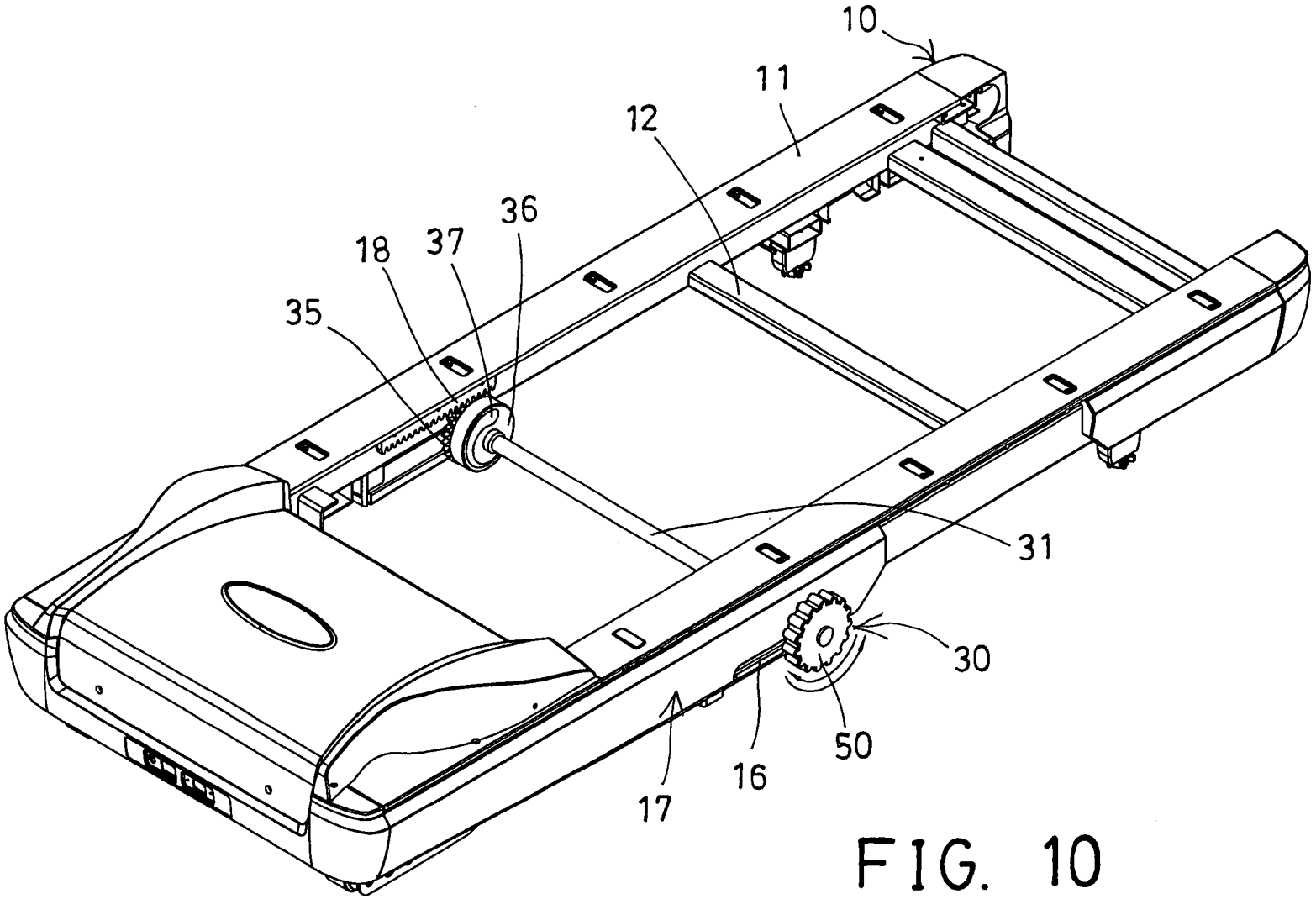
FIG. 10 is a perspective view similar to FIG. 2, illustrating the further arrangement of the treadmill.

Further alternatively, as shown in FIG. 10, without the power driving or actuating or moving means or device 40, a knob 50 may be selectively attached to the rod 31 and the gears 35 and the cushioning members 36 may be secured to the rod 31 and rotated in concert with the rod 31, for manually rotating the rod 31 and thus the cushioning members 36 relative to the tread base 10 and for changing or adjusting the position of the grooves 37 of different or gradually changed thickness or depth and thus for adjusting or changing the resilience or the cushioning force of the cushioning members 36 applied to the tread deck 20.

Accordingly, the treadmill in accordance with the present invention includes a changeable or adjustable suspension system for changeably or adjustably supporting a treadmill deck and for providing the user-variable impact restraint.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A treadmill comprising:

a tread base including two side beams each having a channel formed therein, and including at least one rack arranged parallel to either of said channels of said tread base, a rod including two ends slidably received in said channels of said tread base, at least one gear disposed on said rod and engaged with said at least one rack of said tread base for rotating said at least one gear relative to said tread base when said at least one gear is moved relative to said at least one rack, a tread deck supported on said tread base, and at least one cushioning member disposed on said rod and engaged with said tread deck for cushioning said tread deck and for absorbing impact loads imparted on said tread deck by a user, said at least one cushioning member including different resilience for applying different cushioning force onto said tread deck when said at least one cushioning member is rotated relative to said tread base.

2. The treadmill as claimed in claim 1, wherein a collar is rotatably disposed on said rod and coupled to said at least one cushioning member and said at least one gear.

3. The treadmill as claimed in claim 1 further comprising a moving means for moving said rod relative to said tread base.

4. The treadmill as claimed in claim 3, wherein said moving means includes an actuator coupled between said rod and said tread base for moving said rod relative to said tread base.

5. The treadmill as claimed in claim 1, wherein said at least one cushioning member includes at least one curved groove for forming different resilience to said at least one cushioning member.

6. The treadmill as claimed in claim 5, wherein said at least one curved groove of said at least one cushioning member includes a depth changing from a wider end toward a narrower end.

7. The treadmill as claimed in claim 1, wherein said at least one cushioning member includes two opposite curved grooves for forming different resilience to said at least one cushioning member.

* * * * *